US009824555B2

(12) United States Patent
Hefer et al.

(10) Patent No.: US 9,824,555 B2
(45) Date of Patent: Nov. 21, 2017

(54) SENSOR SYSTEM FOR MONITORING AN OBJECT

(71) Applicant: Fraunhofer-Gesellschaft zur Foerderung der angewandten Forschung e.V., Munich (DE)

(72) Inventors: Jan Hefer, Berlin (DE); Johannes Rojahn, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 235 days.

(21) Appl. No.: 14/427,984

(22) PCT Filed: Sep. 11, 2013

(86) PCT No.: PCT/EP2013/068830
§ 371 (c)(1),
(2) Date: Mar. 12, 2015

(87) PCT Pub. No.: WO2014/041025
PCT Pub. Date: Mar. 20, 2014

(65) Prior Publication Data

US 2015/0221192 A1 Aug. 6, 2015

(30) Foreign Application Priority Data

Sep. 13, 2012 (DE) ..... 10 2012 018 620

(51) Int. Cl.
*G08B 13/14* (2006.01)
*G08B 13/06* (2006.01)
*G08B 29/04* (2006.01)

(52) U.S. Cl.
CPC ..... *G08B 13/06* (2013.01); *G08B 13/1463* (2013.01); *G08B 29/046* (2013.01)

(58) Field of Classification Search
CPC ..... G08B 13/2431; G08B 13/1463; G08B 13/1454; G08B 13/1409; G08B 13/2434;
(Continued)

(56) References Cited

U.S. PATENT DOCUMENTS 4,639,713 A * 1/1987 Kitagawa ..... B62H 5/003 250/221
4,998,094 A * 3/1991 Englmeier ..... G08B 13/2431 340/521

(Continued)

FOREIGN PATENT DOCUMENTS

DE 102012018620 B4 3/2014
FR 2877473 A1 * 5/2006 ..... G08B 13/1472
WO 2014041025 A1 3/2014

OTHER PUBLICATIONS

International Preliminary Examination Report issued in PCT/US2013/068830, dated Mar. 26, 2015, 8 pages.

(Continued)

*Primary Examiner* — Hoi Lau
(74) *Attorney, Agent, or Firm* — Faegre Baker Daniels LLP

(57) ABSTRACT

A sensor system for monitoring an object, including at least one first part and one second part, of which one is a sensor module having at least one sensor, and at least one fastener to fasten the first part to the object to be monitored, wherein the first part and the second part are designed to establish a releasable connection between the second part and the first part and wherein one of the parts is equipped with a signaling device, which is designed to detect a release of the connection between the second part and the first part and to produce a signal triggered thereby, wherein the fastening of the first part to the object cannot be released nondestructively in a state in which the connection between the second part and the first part exists.

20 Claims, 8 Drawing Sheets

(58) Field of Classification Search
CPC . G08B 13/149; G08B 13/126; G08B 13/1427
USPC ..... 340/521, 566, 572.1, 541, 568.2, 568.8, 340/568.1, 568.4, 572.3
See application file for complete search history.

(56) References Cited

U.S. PATENT DOCUMENTS

| | | | | |
|---|---|---|---|---|
| 5,574,430 | A * | 11/1996 | Ott | G08B 13/1463 340/566 |
| 5,959,532 | A * | 9/1999 | Fujiuchi | G08B 13/1454 340/572.1 |
| 6,087,939 | A | 7/2000 | Leyden et al. | |
| 2002/0130776 | A1* | 9/2002 | Houde | E05B 45/005 340/541 |
| 2009/0267766 | A1* | 10/2009 | Pasma | G08B 13/1409 340/568.2 |
| 2010/0315239 | A1 | 12/2010 | Yang | |
| 2012/0218109 | A1* | 8/2012 | Tatsumi | G08B 13/1463 340/568.8 |

OTHER PUBLICATIONS

International Search Report and Written Opinion issued in PCT/EP2013/068830, dated Nov. 25, 2013, 18 pages.

* cited by examiner

SENSOR SYSTEM FOR MONITORING AN OBJECT

CROSS-REFERENCE TO RELATED APPLICATIONS

This application is a national phase application of PCT Application No. PCT/EP2013/068830, internationally filed Sep. 11, 2013, which claims priority to German Application No. 10 2012 018 620.7, filed Sep. 13, 2012, both of which are herein incorporated by reference in their entirety.

TECHNICAL FIELD

This disclosure relates to sensor systems and, more particularly, to sensor systems for monitoring objects.

BACKGROUND

Some sensor systems serve to monitor a work of art or another object that should be protected from forgery, theft, or damage by external influences, for example. Sensor systems of this type can be set up to measure various environmental conditions that are relevant for preservation of the object (e.g., temperature, atmospheric humidity, and brightness). They can also serve to allow location of the object monitored by them and/or pick up and shaking of the object. A sensor system of this type is described, e.g., in the publication US 2010/0315239 A1.

To ensure uninterrupted monitoring and, in case of a movable object, at least to make it more difficult for it to be stolen or for an original to be replaced unnoticed by a forgery, it is desirable that it be difficult for a sensor system of the type portrayed to be removed from the object to be monitored.

SUMMARY

This disclosure describes a sensor system for monitoring objects. The sensor system can be attached to an object to be monitored in the simplest possible manner, however it cannot be removed from the object unnoticed.

The sensor system described in this disclosure for monitoring an object, such as, for example, a work of art, comprises at least a first part and a second part, one of which is a sensor module with at least one sensor, and at least one fastener or means of fastening to fasten the first part to the object to be monitored. This first part and second part are designed to produce a detachable connection between the second part and the first part.

One of the two parts is equipped with a signal transmitter that is set up to detect if the connection between the second part and the first part is undone, and to produce a signal triggered by this. Thus, when the sensor system is separated from the object, if the second part is first separated from the first part, this is recognized by the signal transmitter, which then produces the signal. This prevents the second part of the sensor system being removed from the first part, and thus from the object to be monitored, without being noticed.

The sensor system also provides that in the state in which the second part and the first part are connected in the way mentioned, the fastening of the first part to the object cannot be undone in a nondestructive way, that is, not without at least partly destroying or damaging the object and/or the sensor system. Thus, the first part and the second part are made in such a way that they prevent the first part being unfastened from the object in a nondestructive way. Thus, if the connection between the second part and the first part is not undone before the first part is separated from the object—which as was said cannot be done without being noticed—this fastening of the first part to the object can only be undone by at least damaging the object and/or the sensor system at the same time. Since this damage of the object and/or the sensor system can either already be detected while the fastening is being undone—because of the force required to undo the fastening, which is accompanied by shaking—or at least leave traces behind that remain recognizable and can subsequently be discovered, in any case it is impossible to detach the sensor module—whether this be the first part or the second part of the mentioned parts—from the object to be monitored without this being noticed.

The signal that is triggered by undoing the connection between the two parts can be an acoustically or visually perceptible warning signal, for example. However, it can also be a radio signal or another signal that can be received by means of an appropriately set up external receiver. It is also possible for the signal transmitter to be set up to detect undoing of the fastening of the first part to the object in the state in which the two parts are connected, and to produce a signal triggered by this, for which the same can apply as does for the first-mentioned signal. As a rule, the signal transmitter has a correspondingly designed sensor element to detect undoing of the connection between the second part and the first part. The sensor element can be in the form of a contact sensor, a mechanical button or switch, a magnetic element, a piezoelectric or piezoresistive element, a capacitive or inductive sensor, or a temperature sensor, or an optical sensor or light barrier, or part of a circuit loop. The first part or the second part can have, for example, a bulge or a projection that exerts, in the state in which the two parts are connected, a counterforce on the sensor element that puts the sensor element into a predetermined state (for example pressed together) and/or keeps it in this state, as soon and/or as long as the second part and the first part are connected.

If the second part is the sensor module, the first part of the sensor system can be an adapter, which connects the sensor module with the object. In this case, the proposed sensor system makes it possible for the sensor module to keep the same shape for various applications, and only adapt the shape of the adapter to that of the object to be monitored, so that the adapter and, through the adapter, also the sensor module can be securely fastened to the object without it being necessary to change the shape of the sensor module, which typically requires a great deal of effort and can also be costly. It is preferable for the adapter to be made of a plastic, so that it can economically be made in any desired shape. It is advantageous if the adapter does not, as a rule, require electrical and/or electronic components. Such components can be completely integrated into the sensor module or into another functional module of the sensor system that might be provided. In particular, it is expedient for the mentioned signal transmitter that is intended to detect separation of the two parts to be arranged in the sensor module.

As a rule, the adapter has a contact surface that faces one surface of the object when the adapter is fastened to the object to be monitored in the way it is supposed to be. When the adapter is fastened to the object in the way it is supposed to be, the mentioned contact surface and the surface of the object typically make contact over an extensive area. It is preferable for the mentioned contact surface of the adapter to be designed or shaped complementary to the surface of the object, to allow it to be fastened to the object as securely and gently as possible.

The sensor system can be provided with at least two different adapters, that is, the mentioned at least one adapter comprising a first adapter, a second adapter, and possibly even more adapters, which can have differently shaped or designed contact surfaces. For example, one dimension of the contact surface of the first adapter can differ from a dimension of the contact surface of the second adapter and/or a curvature of the contact surface of the first adapter can differ from a curvature of the contact surface of the second adapter. The contact surface of each of the adapters can be, for example, flat, convex, concave, round, angular, or designed in any other shape or mixture of shapes.

Thus, for example, the sensor system can be provided with several of the mentioned adapters, each of which has a different contact surface, so that for a given object with a given surface, it is possible to select the one of these adapters whose contact surface matches the surface of the object especially well, and thus can be fastened to the object especially securely. For example, if the object has a convex surface, that is, bulging outward with a certain radius of curvature, it is preferable to select that adapter whose contact surface has a shape as complementary as possible to it, thus, one that is concave, i.e., bulging inward, and whose radius of curvature is as similar as possible. The result is the advantage that we have already indicated, that fastening the sensor system to the surface of the object as securely as possible requires that the mentioned contact surface of the adapter have a shape that matches that of the object as closely as possible.

In some embodiments, the sensor system comprises at least one sensor element, housed, e.g., in the sensor module, to measure a temperature and/or detect shaking. In this case, the sensor module can also comprise an evaluation system to evaluate output signals of this sensor element, this evaluation system also being set up to detect output signals of the sensor element that are characteristic of destruction of the mentioned part of the object to be monitored or of the sensor system, such as, for example, a rise in temperature due to heating of the sensor system (for example, to soften or melt parts of the sensor system) or shaking due to mechanical bending or detachment of parts of the sensor system. The evaluation system can also be set up to produce a corresponding signal, which once again can be an acoustically or visually perceptible warning signal or a radio signal or another signal that can be received by an appropriately set up external receiver.

In some embodiments, the first part comprises an area that has access to the at least one means of fastening. In general, here an area of the first part should be understood to "have access to the at least one fastener or means of fastening" when the means of fastening in this area or from this area are accessible in a nondestructive manner, that is when the means of fastening in this area or from this area can be reached without it being necessary to damage the object or at least part of the sensor system. Thus, the means of fastening are only accessible in a nondestructive manner when the sensor system is in states in which this area with the mentioned access is accessible in a nondestructive manner.

If the fastener or means of fastening are, for example, a screw, rivet, or a comparable mechanical means of fastening, then the first part typically has, for this means of fastening, an opening through it (that is, a hole), through which the means of fastening is or can be passed. As a rule, such means of fastening are accessible in a nondestructive manner when this hole is accessible from a top side opposite the contact surface, that is, when the area of the second part surrounding the hole(s) on the mentioned top side is not concealed or blocked.

In some embodiments, the feature that the first part cannot be detached from the object in a nondestructive manner as long as the second part and the first part are connected can be realized by having the second part block access to at least one fastening element in the mentioned state in which the second part and the first part are connected. This is typically equivalent to making it impossible to access the mentioned area itself (that is, the area that has this access) in a nondestructive manner when in this state; typically this area itself is concealed or blocked by the second part. In this state, if the first part is also fastened to the object by the at least one means of fastening, the means of fastening itself typically also cannot be accessed in a nondestructive manner. The obstruction or blocking of the mentioned access to the means of fastening (or of the area with this access) then makes it impossible or at least substantially more difficult to undo the mentioned fastening of the first part to the object to be monitored in a nondestructive manner (and thus without being noticed or leaving a trace). In any case, in this state it is impossible to undo the means of fastening in the way predetermined for this means of fastening, that is, for example, in the case of a screw, unscrewing this screw from the object by turning the screw.

In some embodiments, the second part has, on at least one of its outside surfaces, at least one bulge or widening or projection or extension that conceals or blocks the mentioned access to the means of fastening in the state in which the second part and the first part are connected. This at least one bulge or widening or projection or extension can be ribbed or lamellar, for example. In some embodiments, this widening or projection is to be as stable and solid as possible, and it can have, for example, a metallic (e.g., steel) component or also be made completely of metal, for example of a steel.

In some embodiments, the means of fastening or at least one of the means of fastening is designed to fasten the first part to the object in a form-fit and/or frictional manner. For example, it can be a screw or a rivet. However, the means of fastening can also be an adhesive to fasten by material bonding. It is also conceivable to use a combination of various means of fastening, such as for example any combination of the examples mentioned here. In some embodiments, the adhesive serving as means of fastening can be softened or undone by applying an electrical voltage to the mentioned access and/or by heating the mentioned access. Adhesives with the required properties are known, e.g., from the article of J. Kolbe and M. Stuve that appeared in Adhäsion—Kleben and Dichten 50 (2006) 9, pp. 28-30.

In some embodiments, the mentioned fastening of the first part to the object can be undone in a nondestructive manner in a state, in which the second parts are not connected in the way mentioned. This is the case, for example, in the state in which the second part and the first part are not connected in the way mentioned when the means of fastening are accessible in a nondestructive manner, for instance to undo the means of fastening in the way they are supposed to be undone; in the case of screws, for example, to unscrew them from the object.

However, it is possible that the fastening of the first part to the object cannot be undone without damage even in a state in which the sensor module and the adapter are not connected in the way mentioned. For example, the sensor system can be provided with an electric circuit comprising a circuit loop that can pass through part of the object, and at least one section of the electric circuit that is connected with the circuit loop and passes through the first part (this section of the electric circuit can in turn comprise several subsections, typically two) and another section of the electric circuit running through the second part. In the state in which the second part and the first part are connected in the way mentioned, the circuit loop, the at least one section of the electric circuit running through the first part, and the other section of the electric circuit running through the second part are connected with one another so that the entire electric circuit is or can be closed. In this case, the signal transmitter can be set up to detect an interruption in this electric circuit (for instance, in the form of a change in the electrical resistance of the electric circuit) and then produce a signal triggered by this, as described above.

In some embodiments, the circuit loop is fastened to the object to be monitored when the first part, that is, typically the adapter, is fastened to the object; the mentioned circuit loop is fastened to the object in such a way, for example by being glued or passed through the object, that separation of the first part from the object is only possible after that by severing the circuit loop, that is by damaging and consequently partly destroying the sensor system. For example, in the case when the object is a picture with a canvas, the circuit loop can be woven with part of the canvas.

In some embodiments, the adapter forming the first part is in the form of a plate or a frame. For example, the adapter can have a first longitudinal member and a second longitudinal member, and at least one transverse member connecting the first longitudinal member with the second longitudinal member. In some embodiments, the adapter is U-shaped, and in this case comprises two of the longitudinal members and one of the transverse members.

In some embodiments, the longitudinal members and the at least one transverse member are designed in such a way that the sensor module is positioned between these longitudinal members when it is in the state in which it and the adapter are connected as previously described. In the state in which the sensor module and the adapter are connected, the longitudinal members and the at least one transverse member at least partly form a frame around the sensor module.

In some embodiments, to connect the second part and the first part as previously described, the two parts have connection elements that are complementary to one another. For example, each of the connection elements can be in the shape of a rail, a groove, a channel, a key, a tongue-and-groove joint, a bulge, a gap, a recess, a depression, or designed in the shape of a catch, for example a latch lug or a clip. In some embodiments, the first part and the second part each comprise at least one such connection element; in some embodiments, each can comprise two or more such connection elements. In some embodiments, the connection elements are to be designed in such a way that the sensor module and the adapter can repeatedly be connected and disconnected. In the state in which the second part and the first part are connected, the connection elements are typically engaged in one another, interlocked, and/or frictionally connected. In some embodiments, the two parts are pushed together or into one another, allowing them to be connected by means of the connection elements.

In some embodiments, the connection elements are arranged on the side surfaces of the two parts. For instance, in the example described above, in which the adapter has longitudinal members and at least one transverse member, the connection elements of the adapter can be arranged on facing sides of these longitudinal members.

In some embodiments, it is possible for the sensor system proposed here to be made especially flat. In some embodiments, the maximum height of the first part or the adapter is no larger than a maximum height of the second part, which is that of the sensor element. Here the mentioned heights are defined as dimensions in a direction perpendicular to the contact surface described above, that is, perpendicular to the surface of the object when the sensor system is fastened to the object. In some embodiments, the maximum height of the at least one adapter can be even smaller than the maximum height of the sensor element, so that the latter projects above the adapter.

In some embodiments, constructing the sensor system in an especially spatially compact way makes it possible to fasten the sensor system to the object in such a way that a person observing the object does not perceive it, or hardly perceives it, or at least does not perceive it as disturbing. In some cases, making it compact even makes it possible to arrange the sensor system completely or at least partly within a hollow space in the object.

In some embodiments, the sensor system comprises, in addition to the sensor module, at least one functional module, which has an energy storage system that is intended to supply the sensor module with electrical energy and that should allow replacement without this requiring the sensor module being removed from the object and being put out of operation. The functional module can be the second part of the sensor system if the first part is provided by the sensor module. However, the functional module can be the first part of the adapter and the second part of the sensor module. In these embodiments, the at least one functional module is set up for a detachable connection with the sensor module and/or with the adapter. To accomplish this, the functional module can have also connection elements that interact with the adapter's connection elements already described above, and that can be of the same type as those of the sensor module. In some embodiments, the adapter, the functional module, and the sensor module are to be designed in such a way that in the state in which the sensor module and the adapter are connected at the same time as the functional module and the adapter are connected, the functional module and the sensor module are arranged relative to one another and to the adapter in such a way that they are arranged essentially at the same height relative to the above-mentioned contact surface of the adapter. In this case, the functional module and the sensor module are arranged next to one another when viewed from the direction of the contact surface (that is, from the direction of the object). The result of this is that the sensor system is very flat, and thus advantageously projects as little as possible over the surface of the object.

In some embodiments, when the adapter is, as described above, designed in the form of a frame and has two longitudinal members and at least one transverse member connecting the two longitudinal members, the functional module (as well as the sensor module) and the adapter are designed in such a way that in the state in which the functional module and the adapter are connected, the functional module is positioned between the first and second longitudinal members (and possibly next to the sensor module). The result of this is that the adapter has an especially flat and also simple structure, since the adapter's connection elements can be designed to connect the functional module and to connect the sensor module with the adapter simultaneously.

The sensor module and the functional module can each comprise one or more sensor elements. This or these sensor element(s) can be set up to measure a temperature, an atmospheric humidity, a radiation intensity, or another parameter, for example one that characterizes an environmental condition that is relevant for preservation of the object to be monitored. It is also possible for the sensor element or at least one of the sensor elements to be set up to pick up shaking of the sensor system or of the object and/or to detect harmful substances. This makes it possible to detect unauthorized manipulation of the sensor system, as described above. It is also possible for one of the at least one sensor elements to receive positioning signals of a preferably satellite-based positioning system (such as, e.g., a GPS or another positioning system) to locate the sensor system and possibly the object to be monitored.

The functional module and the sensor module can each have at least one interface that can be set up to exchange data and/or to transfer energy between the sensor module and the functional module. For example, the functional module can have an energy storage system that is set up to supply energy through the above-mentioned interfaces to power-consuming components contained in the sensor module, such as, for example, the already mentioned sensor elements. In addition, the sensor module can have an energy storage system to supply energy to power-consuming components contained in the sensor module, for example, while the functional module is separated from the sensor module.

In some embodiments, the functional module and/or the sensor module can have interfaces that allow the transfer of measurement signals of at least one external sensor element to the sensor module and/or to the functional module. At least one external sensor element can be part of the sensor system and also be fastened to the object to be monitored, for example. In particular, it can be used to pick up the intensity of radiation or light, for example on a front side of a work of art to be monitored, if the sensor system's main components—that is especially the first and the part—are hidden on the back of the work of art.

The sensor system can also have at least one plug connected with the external sensor that is set up for a detachable plug-and-socket connection with the second part of the sensor system, the first part of the sensor system having a recess into which the plug can be inserted; in the state, in which the second part is connected with the first part, the plug is blocked in this recess and its plug-and-socket connection with the second part is locked at least when the first part is fastened to the object with the at least one means of fastening.

Similarly, the sensor system can have at least one additional functional element that is set up for a detachable plug-and-socket connection with the second part of the sensor system, the first part of the sensor system having a recess into which the functional element can be inserted; in the state, in which the second part is connected with the first part, the functional element is blocked in this recess and its plug-and-socket connection with the second part is locked at least when the first part is fastened to the object with the at least one means of fastening.

The functional module and/or sensor module can comprise a transmitter to send measurement signals of the mentioned sensor element or signals or warning signals derived from them to an external receiver. For example, the functional module and/or sensor module can comprise an evaluation system to evaluate measurement signals of the mentioned sensor elements. For example, it is possible for such an evaluation system to monitor, on the basis of measurement signals, whether the environment of the object meets specified conditions, e.g., with respect to temperature, atmospheric humidity, radiation exposure, brightness, and/or vibrations. The evaluation system can also be used to derive other information from the measurement signals, such as, for instance, measurement of a burden limiting the life of the object or a harmful effect of the environment on the object. The functional module and/or sensor module can also comprise a storage unit to store measurement signals from sensor elements or signals or data derived from them.

The functional module can have the capability of being separated from the adapter and possibly from the sensor module, without this triggering a signal or a warning signal. This makes it possible, for example, to service or calibrate the functional module, or to read out measurement signals and/or data stored in it, and/or to replace it with another functional module, for instance to connect the sensor module with a new or charged up energy storage system and/or fasten to the object a functional module with (additional or supplementary) sensor elements that are especially suitable for monitoring the object.

BRIEF DESCRIPTION OF THE DRAWINGS

Sample embodiments are described below using the drawings. The drawings show.

DETAILED DESCRIPTION

In all figures, recurring reference numbers always refer to the same or comparable features.

Figure 1:
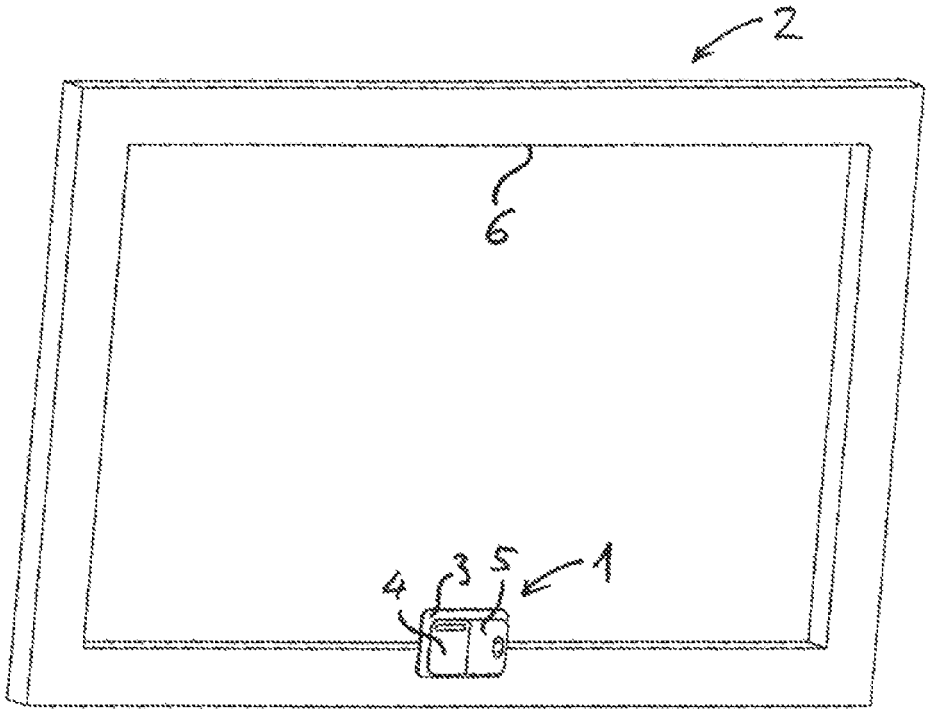
FIG. 1 a perspective view of an object to be monitored with a sensor system to monitor this object, according to embodiments described in the disclosure.
Figure 2:
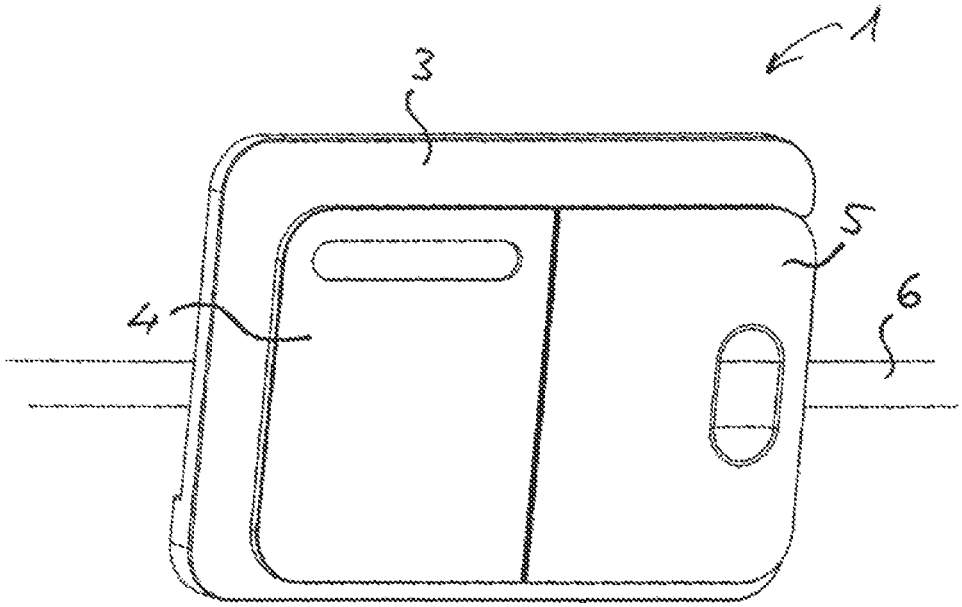
FIG. 2 an enlargement of the sensor system shown in FIG. 1, also in perspective view, according to embodiments described in the disclosure.

FIGS. 1 and 2 are schematic representations of a sensor system 1 to monitor an object 2, which in the case shown is a work of art in the form of a framed painting, according to embodiments described in the disclosure. Sensor system 1 comprises an adapter 3, a sensor module 4, and a functional module 5. Adapter 3 is detachably fastened to a frame 6 of the object 2 by means of several fasteners or means of fastening 11 (see FIGS. 3 and 6). Adapter 3, sensor module 4, and functional module 5 are designed to connect sensor module 4 and adapter 3 and functional module 5 and adapter 3 in a detachable manner. FIGS. 1 and 2 each show a state in which sensor module 4 is connected with adapter 3 and functional module 5 is connected with adapter 3, and in which adapter 3 is also fastened to the frame 6 of object 2.

Sensor system 1 has the advantage that it is sufficient to adapt plastic adapter 3 to the shape of the frame 6 of object 2, while sensor module 3 and functional module 4 can remain unchanged. In addition to the adapter 3 that is shown, sensor system 1 also comprises many other differently shaped adapters, which however are not shown here. Each of these other adapters is also designed to connect sensor module 4 to adapter 3 and functional module 5 to adapter 3 in a detachable manner, and differ from the adapter 3 shown here only by having a differently shaped contact surface that lies against the work of art to be protected. Depending on how the work of art to be protected is shaped at the place where sensor module 4 should be attached, it is then possible in each case to select adapter 3 or other adapters that fit best.

Figure 3A:
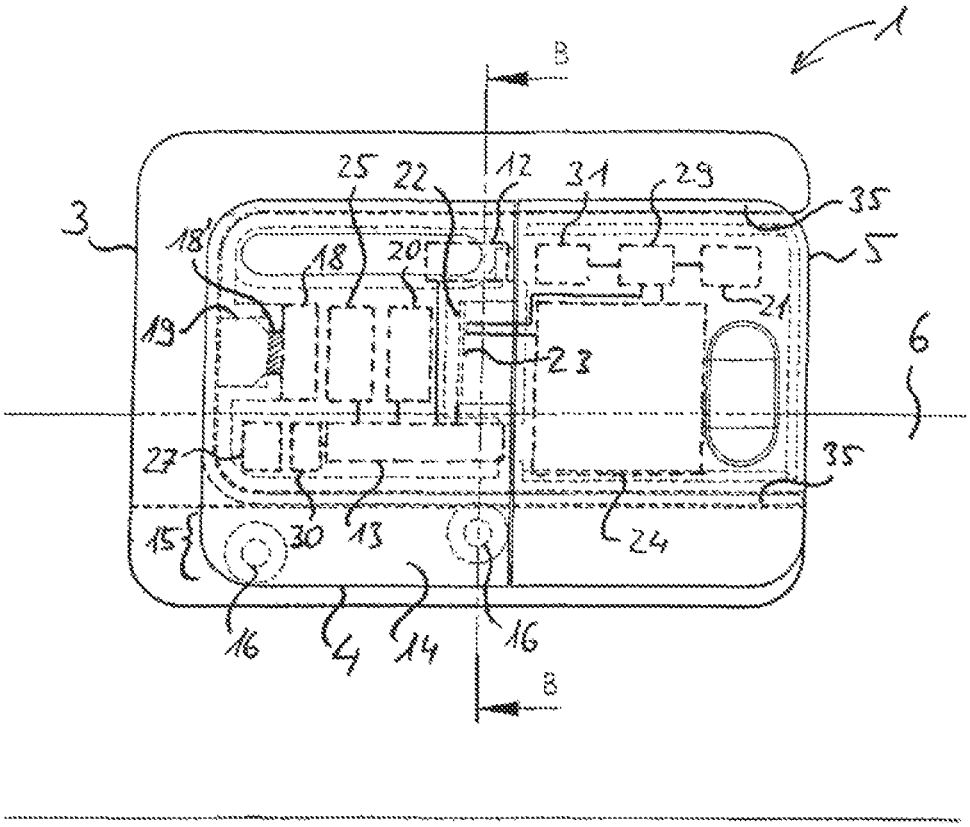
FIG. 3A a top view of this sensor system, here shown partly transparent, according to embodiments described in the disclosure.
Figure 3B:
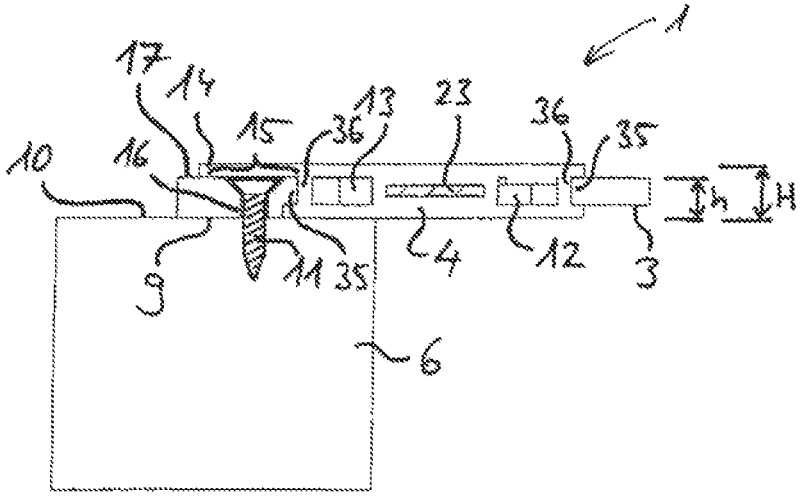
FIG. 3B a cross section of the sensor system from the previous figures, labeled in FIG. 3A with B-B, according to embodiments described in the disclosure.

FIG. 3A, according to embodiments described in the disclosure, shows the sensor system from FIGS. 1 and 2 again in a semitransparent view, so that it is possible to recognize some other features, which will be explained further below in greater detail with reference to FIG. 4. FIG. 3B shows a cross section of the same sensor system at the place labeled with B-B in FIG. 3A, according to embodiments described in the disclosure. Sensor module 4, adapter 3, and frame 6 can also be seen there. As can be seen from this depiction, in which adapter 3 is fastened, as mentioned, to the object 2 to be monitored, adapter 3 has a contact surface 9 that faces, in the state shown, one surface 10 of frame 6 of object 2, and lies against this surface 10. Contact surface 9 of the adapter 3 that is shown is flat and thus has a shape that is complementary to surface 10 (also flat) of object 2, to allow adapter 3 to be fastened as securely and gently as possible to object 2. Each of the other adapters (not shown) of sensor system 1 has a differently shaped contact surface, so that the sizes and curvatures of the contact surfaces of each of the adapters differ from one another. These contact surfaces are flat, convex, concave, round, or angularly shaped. Thus, for a given object with a given surface of the object, for example, for a certain frame variant of a picture (stretcher frame, wooden plate, etc.) it is possible to select the one of these adapters whose contact surface fits the surface of the object especially well, and thus can be fastened to the object in an especially secure manner.

FIG. 3B also shows one of the means of fastening 11, in this example screws, however, other embodiments might also use other means of fastening, such as, e.g., rivets or an adhesive that can be detached thermally and/or electrically or in another way, or also one that cannot be detached, or a combination of them. It can be seen from FIG. 3 that in the state in which sensor module 4 and adapter 3 are connected, the fastening of adapter 3 to object 2 cannot be undone in a nondestructive manner, that is, not without at least partly destroying the object and/or sensor system 1. Thus, if the connections between sensor module 4 and adapter 3 are not undone by pulling functional module 5 and sensor module 4 out of adapter 3 before the separation of this fastening of adapter 3 from object 2, this fastening of adapter 3 to object 2 can only be undone by simultaneously destroying or damaging at least part of sensor system 1, whether it be part of frame 6, part of adapter 3, or part of sensor module 4.

In this case, this destruction can already be detected while the fastening is being undone, and it also leaves traces behind that also can still be recognized at a later point in time, for example, on frame 6 or on adapter 3, on sensor module 4, and/or on functional module 5. The sensor module comprises a sensor element 12 to pick up shaking that could occur, e.g., if adapter 3 is violently separated from frame 6 in a damaging way. Sensor module 4 also comprises an evaluation system 13 to evaluate output signals of this sensor element 12, and this evaluation system 13 is also set up to detect output signals of sensor element 12 that point to at least partial destruction of frame 6, adapter 3, or sensor module 4, and are caused, e.g., by shaking due to mechanical bending or severing of parts of sensor systems 1, such as, for instance, widening 14 of sensor module 4.

Evaluation system 13 is also set up to produce or trigger warning signals, e.g., visually or acoustically perceptible signals and/or radio signals that can be received by an appropriately set up external receiver (not shown here). To accomplish this, evaluation system 13 can be connected with appropriately set up signal transmitters of sensor module 4, in particular with the transmitter 27 (shown in FIG. 4) of sensor module 4.

Adapter 3 comprises an area 15 in which adapter 3 has holes 16, through each of which passes one of the means of fastening 11. Area 15 is arranged on a top 17 of adapter 3 that is opposite the contact surface 9 of adapter 3, and surrounds these holes 16. From this area 15, the means of fastening 11 are accessible in a nondestructive manner, that is, they can be reached from area 15 without this causing destruction on object 2 or sensor system 1. That is, as soon as area 15 is accessible in a nondestructive manner, it is possible to remove means of fastening 11 using a tool provided for means of fastening 11, that is, in this case using a screwdriver, and hereby to separate adapter 3 from frame 6, without causing destruction to object 2 or sensor system 1.

In some embodiments, in the state in which sensor module 4 is connected to adapter 3, area 15, and thus also access to the means of fastening 11, be blocked by sensor element 4, so that in this state it is practically impossible to undo adapter 3 with sensor module 4 from object 2 in a nondestructive manner and without being noticed.

This is achieved, in the state in which sensor module 4 is connected to adapter 3 and functional module 5 is connected to adapter 3, by the fact that sensor module [4] and functional module 5 cover area 15 and the at least one means of fastening 11, making them inaccessible.

Sensor module 4 has, on at least one outside surface of sensor module 4, a lamellar bulge or widening 14 that is formed by an extension and forms a projection, this widening 14 or the projection formed by it concealing and blocking the access to the means of fastening in the state, in which sensor module 4 is connected to adapter 3 in. The widening 14 is mechanically stable and solid and can have a steel core.

Figure 4:
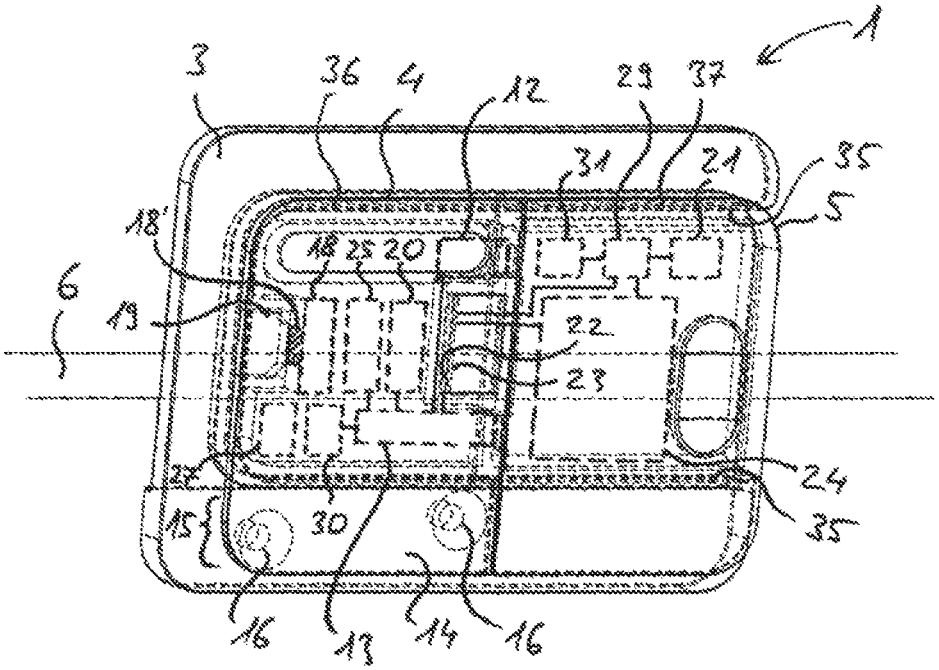
FIG. 4 a semitransparent perspective view of the same sensor system, according to embodiments described in the disclosure.

FIG. 4 shows another semitransparent view of the embodiments from FIGS. 1-3, according to embodiments described in the disclosure. As is schematically shown there, sensor module 4 comprises a signal transmitter 18 that is set up to detect undoing of the mentioned connection between sensor module 4 and adapter 3 and produce a signal triggered by this. The signal is the combination of an acoustically and a visually perceptible warning signal and a radio signal that can be transmitted to an appropriately set up external receiver (not shown here). Signal transmitter 18 has a an appropriate sensor element 18' that is set up to detect undoing of the mentioned connection between sensor module 4 and adapter 3; in this example it is in the form of a contact sensor or a mechanical button or switch. However, it could also just as well be in the form of a magnetic element, a piezoelectric or piezoresistive element, a temperature sensor, or part of a circuit loop. Adapter 3 has a short extension that provides a bulge 19 forming a projection; in the state, in which sensor module 4 and adapter 3 are connected in the way mentioned, this projection exerts a counterforce on sensor element 18' and presses it together, and it keeps it in this state as soon and as long as sensor element 4 and adapter 3 are connected.

As is also shown in FIG. 4, sensor module 3 comprises, in addition to sensor element 13, another sensor element 20, that can be set up to pick up a radiation intensity and/or receive positioning signals of a satellite-based positioning system (e.g., a GPS). Functional module 5 also has a sensor element 21 whose purpose is to detect an atmospheric humidity and a temperature. Sensor module 4 and/or functional module 5 can also have an ID chip. Functional module 4 and sensor module 3 each also have at least one interface 22, 23 for data exchange and/or to transfer energy between the sensor module 4 and the functional module 5. Functional module 5 contains an energy storage system 24 to supply electrical energy to the power-consuming components contained in functional module 5, such as, for example, sensor element 21, and also to supply electrical energy through the above-mentioned interfaces to 22, 23 to the power-consuming components contained in sensor module 4, such as, for example, sensor elements 12, 20. In addition, sensor module 4 also contains a small energy storage system 25 to supply energy temporarily to power-consuming components contained in sensor module 4, while functional module 5 is separated from sensor module 4. This design allows energy storage 24 to be replaced with functional module 5, without interruption in the monitoring of object 2 by sensor module 4. It is expedient for sensor element 21 to be housed in functional module 5, which is exchangeable, since it has a relatively short life and must, like energy storage system 24, be exchanged under some circumstances during the operation of sensor system 1. However, it would also be conceivable for it to be housed together with sensor elements 12, 20 in sensor module 4.

In addition, sensor module 4 has a transmitter 27 for wireless transmission of measurement signals of sensor elements 12, 20, 21 and signals derived from them, and the warning signals, to an external receiver (not shown). In addition to the evaluation system 13 provided in sensor module 4, which is especially set up to evaluate measurement signals of sensor elements 12, 20, it is also possible for an evaluation system 29 to be provided in functional module 5 to evaluate the measurement signals of sensor element 21. Evaluation systems 13, 29 can monitor, on the basis of measurement signals, whether the environment of object 2 meets specified conditions, e.g., with respect to temperature, atmospheric humidity, radiation exposure, brightness, and/or vibrations. Evaluation systems 13, 29 can also derive other information from the measurement signals, such as, for instance, measurement of a burden limiting the life of object 2 or a harmful effect of the environment on object 2. Functional module 5 and/or sensor module 4 can also each have a storage unit 30, 31 arranged in them to store measurement signals from sensor elements 12, 20, 21 or signals or data derived from them.

Functional module 5 can be separated from the adapter and from sensor module 3, without this triggering a signal or a warning signal. However, unannounced separation of the modules does trigger an alarm in the platform of the entire system. Alternatively, if sensor module 4 regularly checks the ID chip of functional module 5, this could also immediately trigger a warning signal. In any case, it is possible to service or calibrate functional module 5, or to read out measurement signals and/or data stored in it, and/or to replace it with another functional module 5, for instance to connect sensor module 4 with a new or charged up energy storage system 24 and/or fasten to object 2 another functional module 5 with (additional or supplementary) sensor elements 21 that are especially suitable for monitoring the object.

Figure 5:
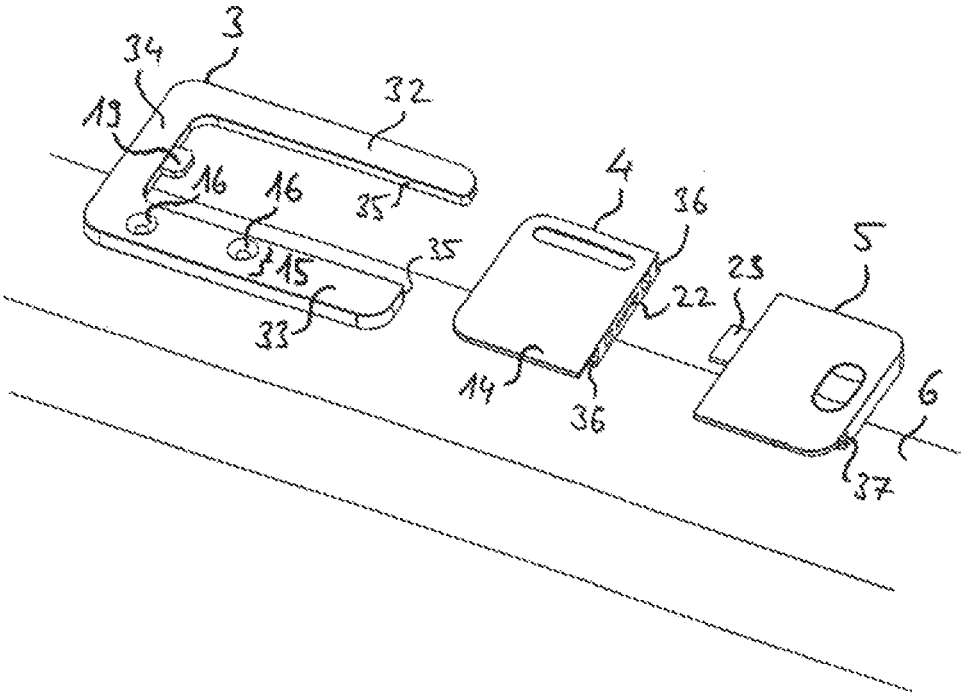
FIG. 5 an exploded perspective view of the sensor system from the previous figures, according to embodiments described in the disclosure.

FIG. 5 shows another view of embodiments shown in FIGS. 1-4, according to embodiments described in the disclosure. This portrayal shows a state of sensor system 1 in which sensor module 4 and adapter 3 are not connected, but rather functional module 5 and sensor module 4 have been pulled out of adapter 3. Here it can be seen that in this state the area 15 of adapter 3, and thus the through holes 16 through which the means of fastening 11 (not shown) pass and in which their screw heads come to lie, can be accessed in a nondestructive manner. Thus, in this state adapter 3 can be separated from object 2, without this having to cause destruction or damage.

It can also be seen that adapter 3 is in the form of a U-shaped, flat frame and has a first longitudinal member 32 and a second longitudinal member 33 and at least one transverse member 34 connecting the first longitudinal member 32 with the second longitudinal member 33. As is especially apparent in FIG. 4, in the state in which sensor module 4 is connected with adapter 3 and functional module 5 is connected with adapter 3, sensor module 4 and functional module 5 are positioned next to one another between these longitudinal members 32, 33 and transverse member 34 and are at least partially surrounded by the frame formed by mentioned longitudinal members 32, 33 and transverse member 34.

As can be seen in FIGS. 3A, 3B, 4, and 5, adapter 3, sensor module 4, and functional module 5 have complementary connection elements 35, 36, 37 to allow sensor module 4 to be connected with adapter 3 and functional module 5 to be connected with adapter 3; each of these connection elements can be designed in the form of a rail or key, a groove, a depression or in the form of a catch, so that the connections can be repeatedly made and undone. In some embodiments, the connection elements 36 provided on sensor element 4 and the connection elements 37 provided on functional module 5 are grooves, while the complementary connection elements 35 provided on adapter 3 are designed as rails or keys. When the connection exists, connection elements 35, 36, 37 are engaged in one another, so that sensor module 4 and functional module 5 are connected in a form-fit manner with adapter 3. In addition, sensor module 4 and functional module 5 are held in place by a frictional connection between connection elements 35, 36, 37. The connection elements 35, 36, 37 are arranged on side surfaces of sensor module 4, functional module 5, and adapter 3; in the case of adapter 3 they are arranged on facing sides of longitudinal members 32, 33.

This advantageously makes it possible to design the unit composed of adapter 3, sensor module 4, and functional module 5 to be especially flat. For example, as can be seen in FIG. 3B, the maximum height h of adapter 3 is no greater than the maximum height H of sensor element 4 and functional module 5. The maximum height h of adapter 3 is even smaller than the maximum height H of sensor element 4 and functional module 5, so that they project above adapter 3.

Figure 6:
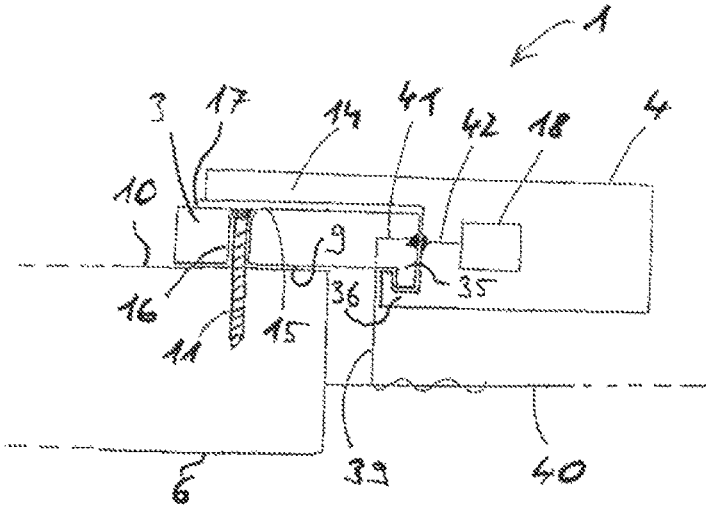
FIG. 6 a cross section of a sensor system to monitor an object, in which the sensor system has an electric circuit that passes through the sensor system and the object to be monitored, according to embodiments described in the disclosure.

FIG. 6 shows a variation of the embodiments shown in FIGS. 1-5 that differs from the embodiments shown in FIGS. 1-5 in that unnoticed separation of sensor system 1 from the object 2 to be monitored is even more difficult, according to embodiments described in the disclosure. To accomplish this, sensor system 1 has an electric circuit. This electric circuit comprises a circuit loop 39 (only partly shown) that passes through a part of object 2—in this case through a canvas 40 of object 2, with which it is woven—and that can, alternatively or additionally, also be glued together with object 2, and two (only one is shown) sections 41 of the electric circuit that are connected with circuit loop 39 and pass through adapter 3, and another section 42 of the electric circuit that passes through sensor module 4.

In the state shown, in which sensor module 4 is connected with adapter 3, circuit loop 39, sections 41 of the electric circuit running through adapter 3, and the other section 42 of the electric circuit running through sensor module 4 are connected with one another, so that the entire electric circuit is closed. In this example, the signal transmitter 18 of sensor module 4 is (also) set up to detect an interruption in this electric circuit (in the form of a change in the electrical resistance of the electric circuit) and then produce a signal triggered by this, as described above. Thus, the only way to separate adapter 3 from object 2 that is still possible is to sever circuit loop 39. Signal transmitter 18 can detect this and produce a signal triggered by this, as described above.

FIG. 6 also shows an alternative shape of connection elements 35, 36, that naturally can be realized independently of how signal transmitter 18 is set up to detect detachment of sensor module 4 from adapter 3. Here the connection element 35 on adapter 3 is provided by an L-shaped rail and the connection element 36 on sensor module 4 is provided by an L-shaped groove corresponding to it. Thus, connection elements 35, 36 produce a form-fit connection between adapter 3 and sensor module 4, without this requiring that adapter 3 have two longitudinal members 32, 33 opposite one another, as in previous sample embodiments. Instead, in this case adapter 3 can also be a single member or a simple plate in the form of a straight strip. As in the previous sample embodiments, sensor module 4 can be pushed together with adapter 3 and also be pulled apart again, however the latter cannot be done without being noticed because of signal transmitter 18. For exact positioning of sensor module 4 on adapter 3, the latter can have a stop (not shown), for example on one end of the rail that forms connection element 35. Of course the rail and groove that form connection elements 35, 36, can also have other cross sections, e.g., the rail can be designed in the form of a T-profile or have a wedge-shaped cross section or be designed in the form of a bulge sitting on a tab. The groove and rail can also be interchanged, so that adapter 3 has a groove and sensor module 4 has a rail guiding the groove.

Figure 7:
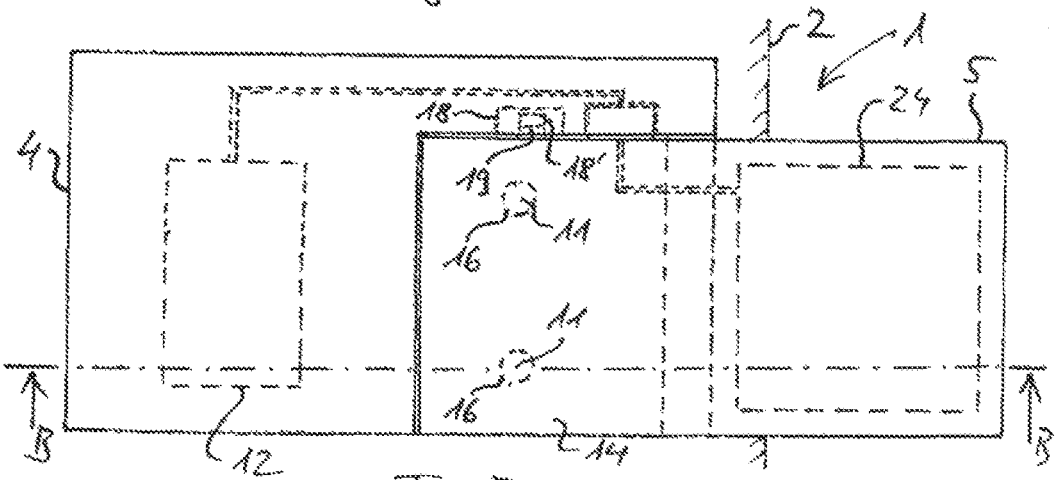
FIG. 7 a top view of a sensor system to monitor an object, according to embodiments described in the disclosure.
Figure 8:
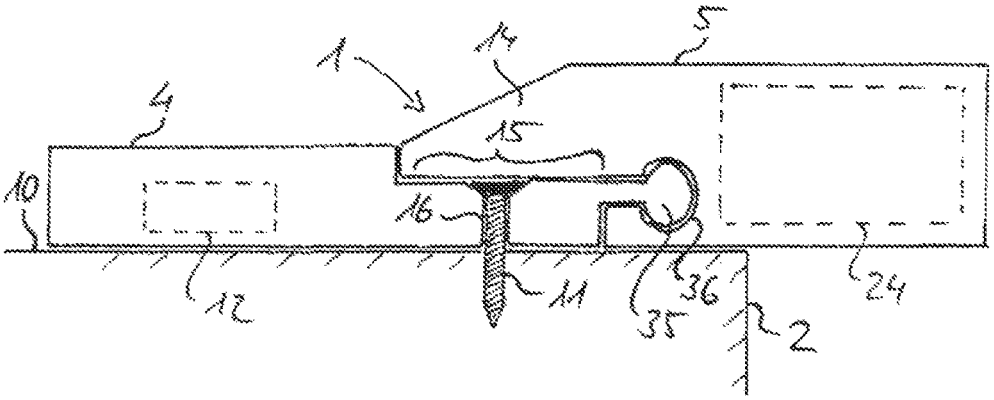
FIG. 8 a cross section of the sensor system from FIG. 7 at the place labeled there with B-B, according to embodiments described in the disclosure.

FIGS. 7 and 8 show embodiments of a sensor system 1 to monitor an object 2, according to embodiments described in the disclosure. This sensor system 1 is designed to have multiple parts, like the previously described sensor systems 1. FIG. 8 shows a cross section of sensor system 1 labeled with B-B in FIG. 7, according to embodiments described in the disclosure. This sensor system 1 differs from some embodiments in that it has a first part that is directly fastened to object 2 by means of fastening 11, which are again provided by screws; here first part is the sensor module 4 itself. In this case, sensor module 4 once again also contains especially a sensor element 12 to measure at least one parameter that is of interest for monitoring of object 2. A second part of the sensor system 1 from FIGS. 7 and 8, namely functional module 5 with the energy storage system 24 to supply sensor module 4, is detachably connected with the first part. The two parts of sensor system 1 are detachably connected using two complementary means of connection 35 and 36, namely a rail provided on sensor module 4 and a groove in functional module 5 holding this rail. Thus, the two parts can simply be pushed together. Here, the part provided by sensor module 4 is comparable with adapter 3, and the part provided by functional module 5 is comparable with sensor module 4. A signal transmitter 18 provided in sensor module 4 is set up to detect breaking of the connection between the two parts and to trigger a signal if this connection is broken. To do this, signal transmitter 18 has a sensor element 18' in the form of a microswitch, for example, that interacts with a bulge 19 now provided on functional module 5. Thus, the two parts cannot be separated from one another without this being noticed.

Functional module 5 is comparable to the sensor element 4 in that it now has a widening 14 that conceals an area 15 with means of fastening 11 as long as functional module 5 is connected with sensor module 4. Therefore, in the state in which the two parts are connected, the fastening of the first part to object 2 cannot be undone in a nondestructive manner. The consequence of this is that the entire sensor system 1 also cannot be separated from object 2 without this being noticed. By contrast, here it is also relatively unproblematic to replace the energy storage system 24 by temporarily separating functional module 5 from sensor module 4.

Figure 9:
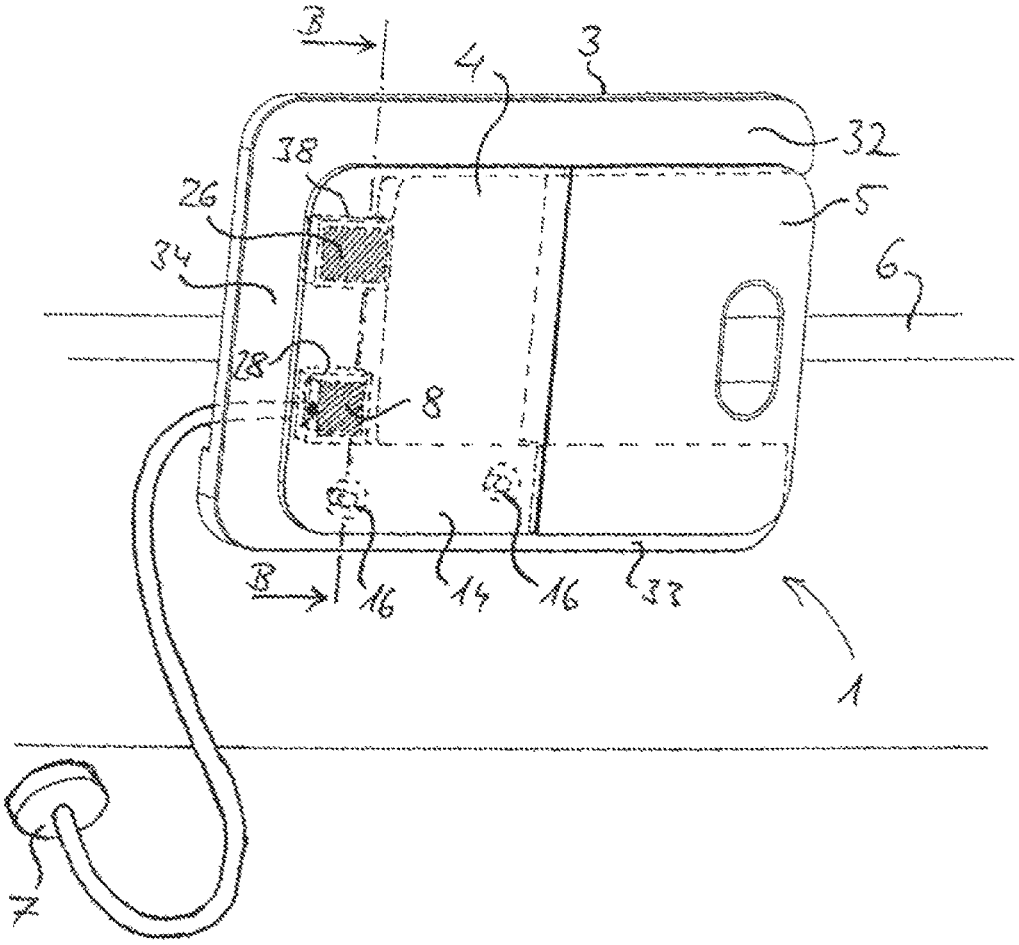
FIG. 9 a perspective view, which is a variation of the sensor system to monitor an object from FIGS. 1-5, according to embodiments described in the disclosure.
Figure 10:
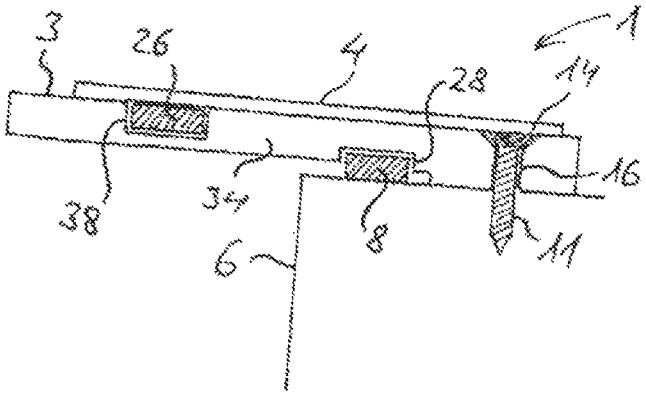
FIG. 10 a cross section of the sensor system from FIG. 9 at the place labeled in FIG. 9 with B-B, according to embodiments described in the disclosure.

Other embodiments are shown in FIGS. 9 and 10, according to embodiments described in the disclosure. FIG. 10 shows a cross section through the sensor module 1 shown in FIG. 9 at the place labeled there with B-B, according to embodiments described in the disclosure. This is a further development of embodiments shown in FIGS. 1-5. It differs in that here transverse member 34 of adapter 3 is somewhat wider and has two recesses 28 and 38.

Recess 38 has a functional element 26 arranged in it that is connected with the sensor module 4 by a detachable plug-and-socket connection. Functional element 26 can be, e.g., an additional sensor to measure a parameter that is of interest for monitoring object 2, which, however, sensor elements 12, 20, 21 do not yet take into consideration. Functional element 26 can also be, e.g., a storage or an ID chip. In the state shown, in which sensor module 4 is connected with adapter 3, the recess 38 holding functional element 26 is covered by the widening 14 of sensor module 4. To do this, widening 14 extends not only over the second longitudinal member 33, but rather also over the transverse member 34. This blocks functional element 26 in recess 38 and locks its plug-and-socket connection with the second part. Since neither the entire sensor system 1 nor sensor module 4 can be removed without this being noticed, it is also impossible to replace or remove functional element 26 without this being noticed.

In addition, the sensor system 1 shown in FIGS. 9 and 10 has an external sensor 7. This external sensor 7 can be used to detect the intensity of illumination or radiation on the front of the work of art, and therefore it is not arranged within sensor module 4 or functional module 5. Instead, the external sensor 7 is arranged outside or on a front surface of the frame 6, and is only connected with sensor module 4 through a cable connection and a plug 8. Plug 8, which, like functional element 26, is connected with sensor module 4 through a detachable plug-and-socket connection, is held by recess 28. Plug 8 also cannot be pulled out without this being noticed, since it is blocked in recess 28 and since its plug-and-socket connection with sensor module 4 is locked as long as adapter 3 is fastened to frame 6 with means of fastening 11. However, this fastening cannot be undone without being noticed, since in the state in which sensor module 4 is connected with adapter 3 this fastening cannot be undone in a nondestructive manner. Of course the recess 28 provided here on the side of adapter 3 facing frame 6 can, like recess 26, also instead be provided on the side facing away from frame 6, and then be covered by widening 14. The variation can be the other way around: recess 38 for functional element 26 can also, like recess 28, be provided at a place facing frame 6.

Figure 11:
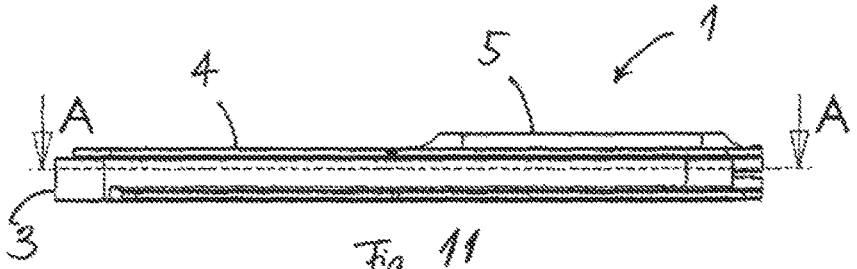
FIG. 11 a side view of a further development of the sensor system shown in FIG. 1, according to embodiments described in the disclosure.
Figure 12:
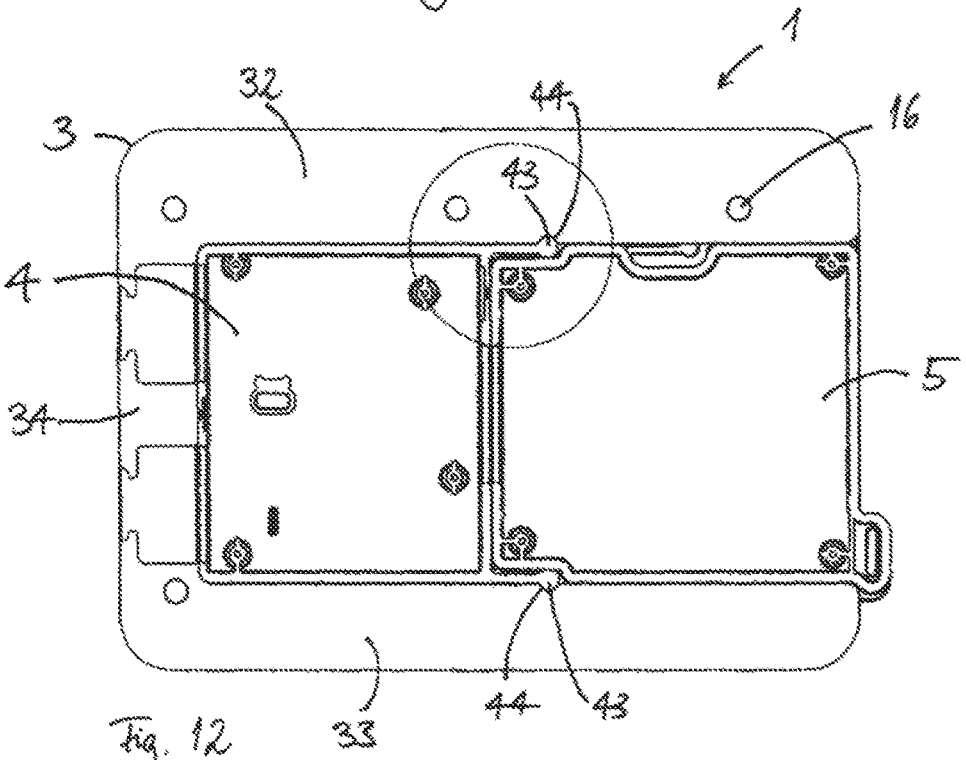
FIG. 12 a cross section of the sensor system from FIG. 11 at the place labeled with A-A in FIG. 11, according to embodiments described in the disclosure.
Figure 13:
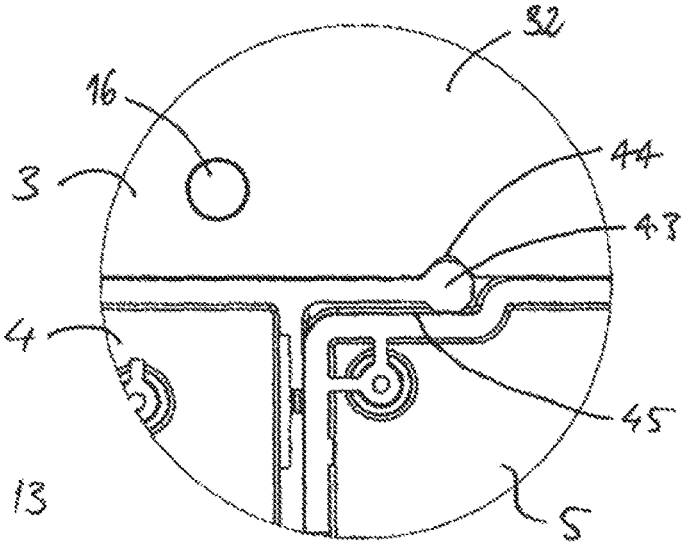
FIG. 13 an enlarged part of the cross section of the sensor system shown in FIG. 12, according to embodiments described in the disclosure.

FIGS. 11 through 13 show another embodiment of a sensor system 1 of the type proposed here, according to embodiments described in the disclosure. FIG. 12 shows a cross section through this sensor system at the place labeled with A-A in the side view from FIG. 11, according to embodiments described in the disclosure. FIG. 13 shows an enlarged detail of the cross section, which is marked in FIG. 12 by a circle, according to embodiments described in the disclosure. Features that correspond to already described features of preceding sample embodiments are given the same reference numbers again. The sample embodiments in FIGS. 11 through 13 differ from the sensor system 1 in FIGS. 1 through 5 only in that they are additionally equipped with a locking device, which can prevent unwanted undoing of the connection between sensor module 4 and adapter 3 when functional module 5 is separated from adapter 3 and from sensor module 4. To do this, the locking device locks the connection between sensor module 4 and adapter 3 in the connected state, this locking being blocked and detachable as long as sensor module 4 is connected to functional module 5.

To accomplish this, the locking device in this case has two movable locking elements 43 linked to sensor module 4 and a receptacle 44 for each of these locking elements 43 provided on adapter 3. The locking elements 43 here are molded on a housing of the sensor module 4 and can be elastically spread out. Instead, locking elements 43 could also be supported in another way in or on sensor module 4 so that they can move. In the state which sensor module 4 is connected to adapter 3, locking elements 43 are pressed into receptacles 44. Functional module 5 in turn has, for each of the locking elements 43, one recess 45 that is shaped in such a way that, in the state in which sensor module 4 is connected to adapter 3, functional module 5 lies against locking elements 43 and thus prevents locking elements 43 moving out of receptacles 44, as long as functional module 5 is connected with sensor module 4 and adapter 3. The locking elements resting in receptacles 44 prevent movement of sensor module 4. This makes it impossible, when removing functional module 5—e.g., to replace or charge up energy storage system 24—to pull sensor module 4 out with it by accident, which would interrupt the monitoring of the object 2 to be protected.

LIST OF REFERENCE NUMBERS

1 Sensor system
2 Object
3 Adapter
4 Sensor module
5 Functional module
6 Frame
7 External sensor element
8 Plug
9 Contact surface of the adapter
10 Surface of the object
11 Means of fastening
12 Sensor element
13 Evaluation system
14 Widening
15 Area
16 Through hole
17 Top
18 Signal transmitter
18' Sensor element of signal transmitter
19 Bulge
20 Sensor element
21 Sensor element
22 Interface
23 Interface
24 Energy storage system
25 Energy storage system
26 Functional element
27 Transmitter
28 Recess
29 Evaluation system
30 Storage unit
31 Storage unit
32 First longitudinal member
33 Second longitudinal member
34 Transverse member
35 Connection element
36 Connection element
37 Connection element
38 Recess
39 Circuit loop
40 Canvas
41 Section
42 Other section
43 Locking element
44 Receptacle
45 Recess

The invention claimed is:

1. A sensor system for monitoring an object, the sensor system comprising:

at least a first part and a second part, wherein the first part or the second part comprises a sensor module including at least one sensor, wherein the first part and the second part are configured to produce a detachable connection between the second part and the first part, wherein the first part or the second part comprises a signal transmitter configured to detect disconnection of the second part from the first part and to produce a signal triggered by the disconnection of the second part from the first part; and at least one fastener to fasten the first part to the object, wherein in a state, in which the second part and the first part are connected and the first part is fastened to the object by the at least one fastener, the fastening of the first part to the object cannot be undone in a nondestructive manner, and wherein the second part is the sensor module and the first part is an adapter configured to connect the sensor module with the object.

2. The sensor system of claim 1, wherein the first part comprises an area with access to the fastener, the access being blocked by the second part in the state in which the second part and the first part are connected.

3. The sensor system of claim 2, wherein the second part has at least one of a bulge, a widening, a projection, and an extension that covers the area with access to the fastener in the state in which the second part and the first part are connected.

4. The sensor system of claim 2, wherein in the area the first part has at least one through hole passing through the first part.

5. The sensor system of claim 1, wherein the first part and the second part comprise connection elements that are complementary to one another to produce the connection between the second part and the first part.

6. The sensor system of claim 1, wherein the at least one fastener is at least one of a screw, a rivet, and an adhesive, that can be undone by at least one of electrically and thermally.

7. The sensor system of claim 1, wherein the fastening of the first part to the object can be undone in a nondestructive manner in a state in which the second part and the first part are not connected.

8. The sensor system of claim 1, wherein the sensor system comprises an electric circuit, the electric circuit comprising a circuit loop, at least one section of the electric circuit that is connected with the circuit loop and runs through the first part, and another section of the electric circuit running through the second part, wherein in the state in which the second part and the first part are connected, the section of the electric circuit running through the first part and the other section of the electric circuit running through the second part are connected with one another to close the electric circuit, the signal transmitter being configured to detect an interruption of the electric circuit and produce the signal triggered by this.

9. A sensor system for monitoring an object, the sensor system comprising:

at least a first part and a second part, wherein the first part or the second part comprises a sensor module including at least one sensor, wherein the first part and the second part are configured to produce a detachable connection between the second part and the first part, wherein the first part or the second part comprises a signal transmitter configured to detect disconnection of the second part from the first part and to produce a signal triggered by the disconnection of the second part from the first part; and at least one fastener to fasten the first part to the object, wherein in a state, in which the second part and the first part are connected and the first part is fastened to the object by the at least one fastener, the fastening of the first part to the object cannot be undone in a nondestructive manner, and wherein the signal transmitter has a sensor element configured to detect undoing of the connection between the second part and the first part, the sensor element being in the form of at least one of a contact sensor, a mechanical button, a mechanical switch, a magnetic element, a piezoelectric element, a piezoresistive element, a capacitive sensor, an inductive sensor, an optical sensor, a temperature sensor, and part of a circuit loop.

10. A sensor system for monitoring an object, the sensor system comprising:

at least a first part and a second part, wherein the first part or the second part comprises a sensor module including at least one sensor, wherein the first part and the second part are configured to produce a detachable connection between the second part and the first part, wherein the first part or the second part comprises a signal transmitter configured to detect disconnection of the second part from the first part and to produce a signal triggered by the disconnection of the second part from the first part; and at least one fastener to fasten the first part to the object, wherein in a state, in which the second part and the first part are connected and the first part is fastened to the object by the at least one fastener, the fastening of the first part to the object cannot be undone in a nondestructive manner, and wherein the at least one sensor of the sensor module comprises at least one sensor element configured to measure at least one of a temperature, an atmospheric humidity, a radiation intensity, shaking, harmful substances, and positioning signals of a positioning system.

11. A sensor system for monitoring an object, the sensor system comprising:

at least a first part and a second part, wherein the first part or the second part comprises a sensor module including at least one sensor, wherein the first part and the second part are configured to produce a detachable connection between the second part and the first part, wherein the first part or the second part comprises a signal transmitter configured to detect disconnection of the second part from the first part and to produce a signal triggered by the disconnection of the second part from the first part; and at least one fastener to fasten the first part to the object, wherein in a state, in which the second part and the first part are connected and the first part is fastened to the object by the at least one fastener, the fastening of the first part to the object cannot be undone in a nondestructive manner, and wherein the system further comprises at least one of a functional element and at least one plug connected with an external sensor, the at least one of the functional element and the at least one plug configured for a detachable plug-and-socket connection with the second part of the sensor system, wherein the first part of the sensor system comprises a recess into which the at least one of the functional element and the at least one plug can be inserted, wherein in the state, in which the second part is connected with the first part, the at least one of the functional element and the at least one plug is blocked in this recess and its plug-and-socket connection with the second part is locked at least when the first part is fastened to the object with the at least one fastener.

12. A sensor system for monitoring an object, the sensor system comprising:

at least a first part and a second part, wherein the first part or the second part comprises a sensor module including at least one sensor, wherein the first part and the second part are configured to produce a detachable connection between the second part and the first part, wherein the first part or the second part comprises a signal transmitter configured to detect disconnection of the second part from the first part and to produce a signal triggered by the disconnection of the second part from the first part; and at least one fastener to fasten the first part to the object, wherein in a state, in which the second part and the first part are connected and the first part is fastened to the object by the at least one fastener, the fastening of the first part to the object cannot be undone in a nondestructive manner, and wherein the signal transmitter is a component of the sensor module.

13. The sensor system of claim 1, wherein the adapter is in the form of a plate or a frame.

14. The sensor system of claim 1, wherein the adapter comprises a first longitudinal member and a second longitudinal member and at least one transverse member connecting the first longitudinal member with the second longitudinal member, the sensor module being positioned between the first longitudinal member and the second longitudinal member in the state in which the sensor module and the adapter are connected.

15. The sensor system of claim 1, wherein the sensor system comprises at least two adapters, which can alternatively be used as the first part, each of which has a contact surface, the contact surface facing a surface of the object when the respective adapter is fastened to the object to be monitored, the contact surface of a first adapter of the adapters having at least one of a size and a curvature that is different from a size and a curvature of the contact surface of a second adapter of the adapters.

16. The sensor system of claim 1, wherein the at least one adapter comprises a contact surface that faces a surface of the object to be monitored when the adapter is fastened to the object, a maximum height of the at least one adapter being no greater than a maximum height of the sensor element in the state in which the adapter is connected to the sensor module, the heights being defined as dimensions in the direction perpendicular to the contact surface of the adapter.

17. The sensor system of claim 1, wherein the sensor system additionally comprises at least one functional module which is configured for a detachable connection with at least one of the sensor module and the adapter.

18. The sensor system of claim 17, wherein the functional module and the sensor module each have at least one interface for at least one of the exchange of data and the transfer of energy between the sensor module and the functional module.

19. The sensor system of claim 17, wherein the sensor system further comprises a locking device, which is configured to lock the sensor module with the adapter in the state in which the sensor module is connected to the adapter, this locking being at least one of blocked and not detachable as long as the sensor module is connected to the functional module.

20. The sensor system of claim 19, wherein the locking device comprises at least one movable locking element arranged about the sensor module and at least one receptacle for the locking element provided on the adapter, the functional module being shaped in such a way that in the state in which the sensor module is connected to the adapter it prevents the at least one locking element moving out of the receptacle when the functional module is connected with at least one of the sensor module and the adapter.

* * * * *